US006550069B1

(12) United States Patent
Morrow

(10) Patent No.: US 6,550,069 B1
(45) Date of Patent: Apr. 22, 2003

(54) PADDED SPORTS GLOVE HAVING IMPROVED FLEXIBILITY AND BREATHABILITY

(75) Inventor: David Morrow, Farmington Hills, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

(21) Appl. No.: 09/569,778

(22) Filed: May 12, 2000

(51) Int. Cl.[7] ..... A41D 19/00
(52) U.S. Cl. ..... 2/161.1; 2/16
(58) Field of Search ..... 2/16, 159, 161.1, 2/161.3, 161.4, 161.6, 161.8, 167, 169

(56) References Cited

U.S. PATENT DOCUMENTS 4,484,359 A * 11/1984 Tirinen ..... 2/20
4,497,073 A * 2/1985 Deutsch ..... 2/161
4,677,698 A * 7/1987 Angas ..... 2/161
4,815,147 A * 3/1989 Gazano et al. ..... 2/161
5,390,372 A * 2/1995 Hashimoto et al. ..... 2/161.2
5,511,243 A * 4/1996 Hall et al. ..... 2/16
5,781,929 A * 7/1998 Shikatani ..... 2/16
5,787,506 A * 8/1998 Wilder ..... 2/161.1
5,946,720 A * 9/1999 Sauriol ..... 2/16
5,983,396 A * 11/1999 Morrow et al. ..... 2/161.1
6,122,769 A * 9/2000 Wilder et al. ..... 2/16

OTHER PUBLICATIONS

STX Lacrosse catalog, 1999–2000 issue, p. 9. Published in United States.

* cited by examiner

*Primary Examiner*—John J. Calvert
*Assistant Examiner*—Katherine Moran
(74) *Attorney, Agent, or Firm*—Artz & Artz, P.C.

(57) ABSTRACT

A protective sports glove for the game of lacrosse having a cuff portion, a hand portion, a plurality of finger portions, and a thumb portion. The hand portion has a palm portion and a back portion. The back portion has a plurality of protective padded portions disposed thereon. A wrist guard is elastically coupled to the hand portion. A plurality of vent openings are formed in the back portion of the hand portion. A plurality of mesh portions are disposed on the palm portion in areas that are not intended to provide primary contact with a stick.

69 Claims, 4 Drawing Sheets

PADDED SPORTS GLOVE HAVING IMPROVED FLEXIBILITY AND BREATHABILITY

TECHNICAL FIELD

The present invention relates generally to a protective sports glove. More specifically, the present invention relates to a protective sports glove for use in the game of lacrosse that provides improved protection to a user's hand, while providing improved flexibility, durability , fit and breathability.

BACKGROUND ART

In contact sports, such as lacrosse or hockey, where sticks are essential elements of the game, a player's hands and wrists are especially vulnerable to injury when being checked by another player's stick. For this reason, players typically utilize padded gloves to protect their hands, wrists and lower forearms during play. The areas of a player's hand that are particularly susceptible to injury are those where the glove flexes, because at those locations, the protective padding is typically constructed such that it can bend or flex with a player's joint. However, such bending or flexing, such as at the wrist or knuckle area, can leave the player's joint exposed due to the bending away of the protective padding and, therefore, susceptible to injury.

Accordingly, wrist guards are known in the art for protective sports gloves to provide protection for a player's wrist between the cuff and hand portion. While most prior wrist guards provide adequate protection, they provide limited flexibility and adjustability and are therefore uncomfortable and are often removed by user. It is also a problem to provide a protective guard for a player's wrist between the glove and cuff portion that both protects the user's wrist, also provides flexibility and is not overly bulky.

Additionally, most prior gloves disclose cuffs that are secured directly to the glove portion by stitching. The stitching limits the flexibility of a player's wrist and also cannot be adjusted. U.S. Pat. No. 5,983,396, discloses a configuration where the cuff and glove portion are attached to one another by lacing which allows for improved flexibility and also adjustability. However, the lacing typically must be done by hand and therefore requires significant labor time in order to manufacture the glove, thereby increasing its cost.

Further, many prior gloves attempt to provide limited breathability and flexibility. Therefore, certain gloves have been introduced that utilize mesh material on portions of a player's palm and fingers. However, the mesh material is located in primary areas that contact a stick and because of the amount of movement of the stick in a player's hand, such as through cradling or the like, the mesh material tends to wear quickly and ultimately tear, therefore making the glove illegal. Moreover, some prior gloves have utilized vent holes in the glove to provide ventilation. The vent holes in these prior gloves, however, are relatively small and therefore offer little ventilation. Further, prior gloves that have tried to provide improved breathability through the inclusion of vent holes have done so at the expense of exposing a user's hand to injury at that location.

SUMMARY OF THE PRESENT INVENTION

It is therefore an object of the present invention to provide a protective sports glove for utilization in contact stick sports, such as lacrosse and hockey, having a wrist guard that is coupled to the glove so as to provide maximum protection and flexibility.

It is a further object of the present invention to provide a protective sports glove for utilization in contact stick sports, such as lacrosse and hockey, that is more flexible and therefore more comfortable for a player.

It is still another object of the present invention to provide a protective sports glove for utilization in contact stick sports, such as lacrosse and hockey, that provides more breathability and ventilation than prior gloves without sacrificing durability or protection.

It is yet another object of the present invention to provide a protective sports glove for use in lacrosse that is smaller than prior gloves.

It is still a further object of the present invention to provide a protective sports glove for use in lacrosse that provides a better fit for a user's hand.

In accordance with the above and other objects of the present invention, an improved protective sports glove is provided. The sports glove has a cuff portion for engaging a user's wrist and forearm and a hand portion elastically coupled to the cuff portion. The hand portion has a palm portion on the inner side of the glove and an opposing portion. The glove has a plurality of finger portions extending from the hand portion for receipt of a user's fingers therein and a thumb portion. A wrist guard is secured to the cuff portion and elastically coupled to the hand portion. The back portion of the hand portion has a plurality of protective padded portions. The protective padded portions are cut horizontally to allow a user's hand to flex and also vertically to conform to a user's hand as it holds the stick. At least one vent opening is formed between two protective padded portions disposed on either side of the vertical cut in the back portion. The palm portion of the glove is similarly comprised of a non-mesh material with a plurality of mesh portions, whereby the mesh material is located in the palm portions in areas that are not intended to have primary contact with the handle of a stick and thus will not wear.

These and other features of the present invention will become apparent from the following description of the invention, when viewed in accordance with the accompanying drawings and appended claims.

DETAILED DESCRIPTION OF THE PREFERRED EMBODIMENT

Figure 1:
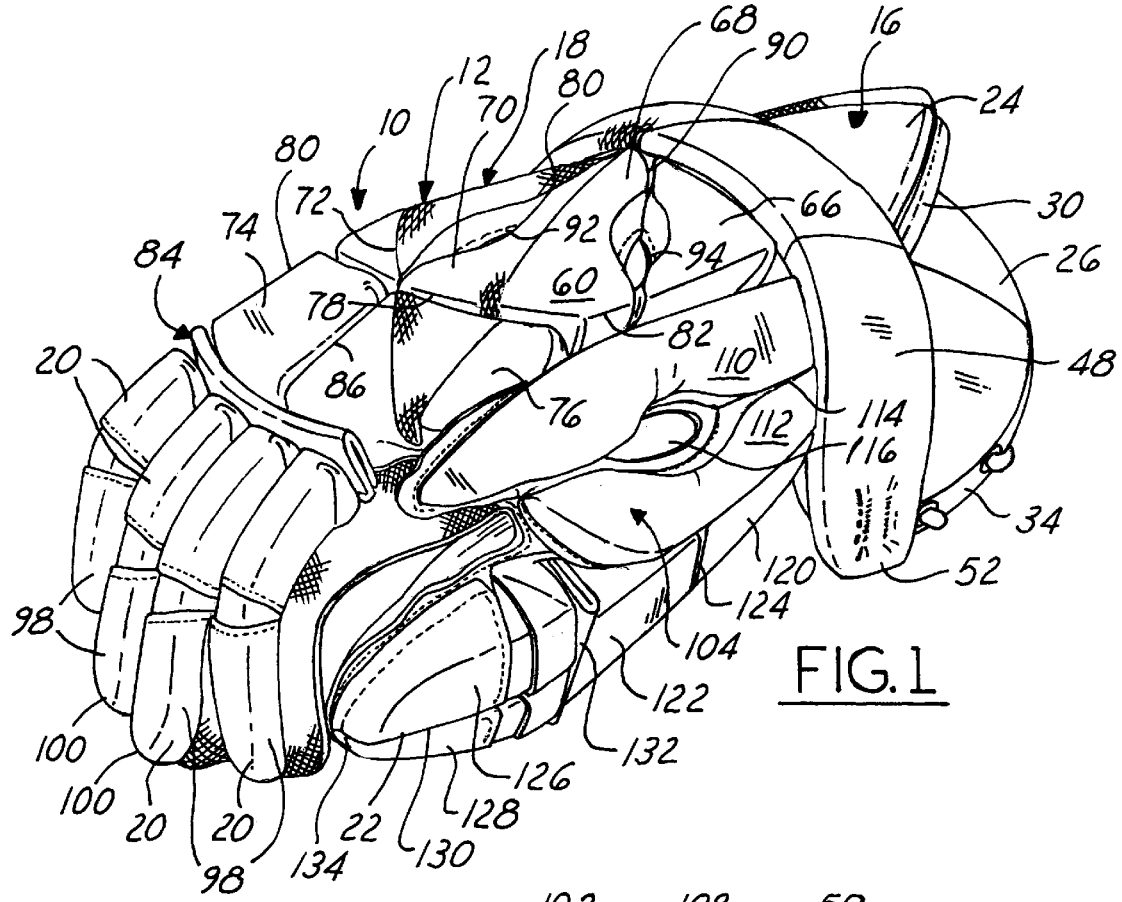
FIG. 1 is a perspective view of a protective sports glove in accordance with a preferred embodiment of the present invention.
Figure 2:
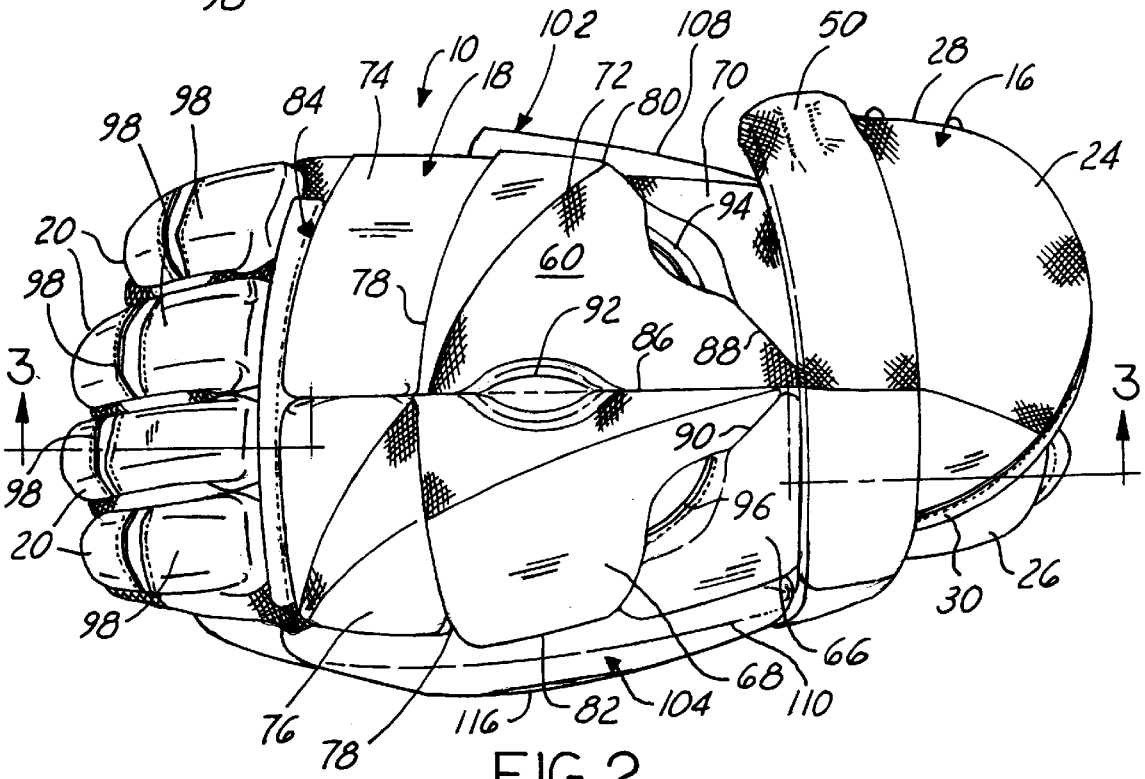
FIG. 2 is a top view of a protective sports glove in accordance with a preferred embodiment of the present invention.
Figure 3:
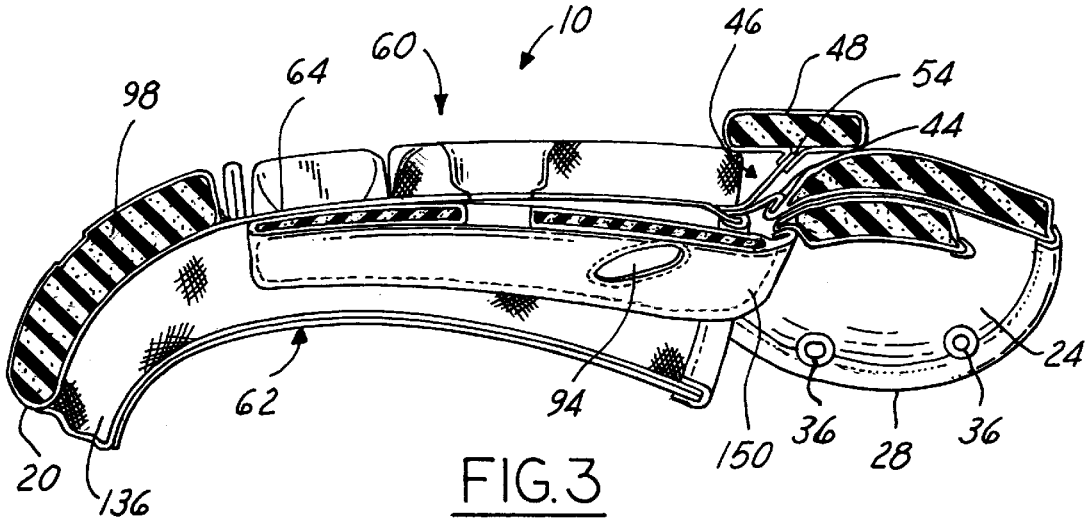
FIG. 3 is a cross-sectional view of the protective sports glove of FIG. 2 along the line 3—3.

Referring now to the Figures, which illustrate a lacrosse glove 10 in accordance with the present invention. The disclosed glove 10 is preferably for use in lacrosse, however, it should be understood that the disclosed glove 10 may be used in any other contact stick sport, including hockey. The glove 10 has a top portion 12 and a bottom portion 14 which therebetween define an interior space for receipt of a lacrosse player's hand. The glove 10 has a cuff portion 16, a hand portion 18 coupled to the cuff portion 16, a plurality of finger portions 20 extending from the hand portion 18 and a thumb portion 22 also extending from the hand portion 18.

Referring now to the FIGS. 1 through 4 and 6, the cuff portion 12 preferably has a first cuff portion 24 and an adjacent second cuff portion 26. The first cuff portion 24 and the second cuff portion 26 are secured at an upper border portion 27. The first cuff portion 24 has a first edge portion 28 and a second edge portion 30. The second cuff portion 26 has a first edge portion 32 and a second edge portion 34. The second edge portion 30 of the first cuff portion 24 overlaps the first edge portion 32 of the second cuff portion 26 to provide a split cuff. The first cuff portion 24 and the second cuff portion 26 are designed to cover and protect substantial portions of a user's wrist and forearm. The overlapping (split cuff) configuration of the cuff portions 24, 26 provides added protection to a user's wrist and forearm because of the double layer of padding. Further, because the cuff portions 24, 26 are not affixed to each other along their adjacent edge portions 30, 32, they can move with respect to one another and therefore provide desired flexibility for a user's wrist as it moves during play.

The first edge portion edge 28 of the first cuff portion 24 preferably has a first set of eyelets 36 formed therein. Similarly, the second edge portion 34 of the second cuff portion 26 has a second set of eyelets 38 formed therein. A lace 40 or other securing device is preferably passed through the first and second set of eyelets 36, 38 to connect the first cuff portion 24 to the second cuff portion 26 and surround a user's forearm when a user's hand is located in the interior space. As shown, the lace 40 is intended to pass around the underside of a user's forearm such that the tightness of the cuff portions 24, 26 with respect to a user's forearm may be adjusted. The lace 40 may be maintained in its desired position at a desired tightness through the use of the cord lock 42 or other similar locking device.

Figure 6:
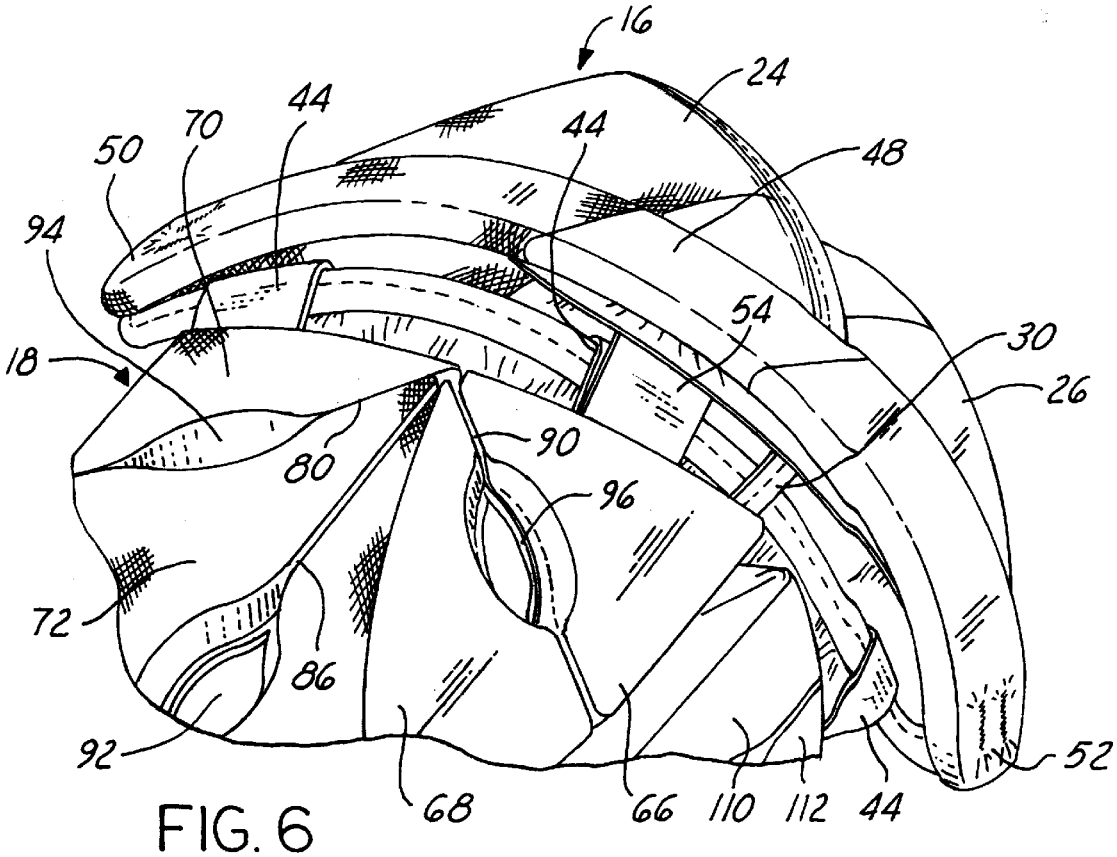
FIG. 6 is an enlarged view of the junction of the cuff portion to the glove portion, which illustrates the wrist guard in accordance with a preferred embodiment of the present invention.

As best shown in FIG. 6, the cuff portion 16 is preferably secured to the hand portion 18 through a plurality of elastic members 44. Each of the elastic members 44 is preferably secured at one end to the upper border 37 of the cuff portion 16 at an opposing end to the hand portion 18. This configuration keeps the cuff portion 16 secured to the hand portion 18. However, the elastic members 44 allow the cuff portion 16 to move with respect to the hand portion 18 and provide flexibility as the user's hand flexes during play. The elastic members 44 are preferably disposed on either side of the cuff portion 16 with a third elastic member 44 being disposed generally in the middle. As the cuff portion 16 moves with respect to the hand portion 18, the back of a player's wrist or hand can be exposed at a seam 46 formed therebetween. Accordingly, a wrist guard 48 is preferably disposed over the seam 46 between the cuff portion 16 and the hand portion 18. The wrist guard 48 has a first end 50, which is preferably secured to the first cuff portion 24 adjacent the first edge portion 28. The wrist guard 48 has a second end 52 which is preferably attached to the second cuff portion 26 adjacent the second edge portion 34. While the first and second ends 50, 52 of the wrist guard 48 are preferably secured to cuff portion 16 by sewing. It should be understood that the ends 50, 52 may be attached by any other known securing means. Alternatively, the wrist guard 48 could instead be secured to the hand portion 18. The integral attachment of the wrist guard 48 to the glove 10 prevents the wrist guard 48 from being removed and therefore provides permanent protection.

Additionally, the wrist guard 48 is preferably coupled to the hand portion 18 by an elastic member 54. The elastic member 54 allows the wrist guard 48 to flex or move as needed during movement by a user's hand during play and still remain over the seam 46. As shown, the wrist guard 48 is preferably located so that it lies over the seam 48 and above the top portion 12 of the glove 10. Alternatively, the wrist guard 48 may be disposed within the interior space of the glove 10 to cover the seam 46 from below the top portion 12.

The hand portion 18 extends between the seam 46 in the finger portions 20 and has a rear portion 60 and a palm portion 62. The rear portion 60 preferably has an inner fabric 64 having a plurality of protected padded portions 66 secured thereto. As shown, the rear portion 60 is preferably subdivided into individual protective padded portions 66, 68, 70, 72, 74, 76. The rear portion 60 of the glove 10 has a first lengthwise cut 78, i.e., from one side 80 of the hand portion 18 to the other side 82 of the hand portion 18, which allows the glove to flex along the lengthwise cut 78 as a user's hand moves. Specifically, the lengthwise cut 78 is cut so that the protective padded portions 74 and 76 are moveable with respect to the adjacent protective padded portions 68 and 72.

The protective padded portions 74, 76 terminate at a junction 84 between the hand portion 18 and the finger portions 20. The junction 84 allows the finger portions 20 to move with respect to the padded portions 74 and 76 as the junction 84 is generally disposed over a user's knuckle area, allowing the finger portions 20 to move as a user's fingers flex. Additionally, the rear portion 60 has a vertical cut 86 that extends generally from the cuff portion 16 to the junction 84. The vertical cut 84 allows the protective padded portions 68 and 76 to move with respect to the protective padded portions 72 and 74, allowing the glove to bend around an axis defined by the vertical cut 84. The vertical cut 84 allows the glove to fit more comfortably as it allows the glove to better conform to a user's hand as he closes his hand around a stick and, therefore, providing a tighter shape. This is necessary as the back of a typical user's hand is not flat, and the padded protected portions are not flexible enough to bend without the vertical cut portion 86. Thus, prior gloves tend to flatten out as a user flexes his hand which causes additional tension to be applied to the palm portions 62.

The rear portion 60 of the hand portion 18 preferably has a pair of opposing angled cuts 88 and 90 which begin generally at the base of the hand portion 18 adjacent the seam 46 and extend generally outward to the respective side 80, 82 of the hand portion 18. The angled cuts 88, 90 similarly assist the glove 10 in conforming to the user's hand as the protective padded portions 66, 70 can each independently move with respect to the other padded portions as a user's hand flexes during play, thus providing a better fitting glove. The cuts 78, 84, 86, 88, and 90, are preferably formed in the glove through die cutting or other known cutting or forming means, which are sufficient to configure the rear portion 60 of the glove to conform to the configuration described above. The rear portion 60 may have a variety of additional or different cuts as desired.

The rear portion 60 of the hand portion 18 has a plurality of vent openings formed therein to provide ventilation to a user's hand. A first vent opening 92 is preferably disposed along the vertical cut 86 between the protective padded portion 68 and the protective padded portion 72. A vent opening 94 is preferably disposed along the first angled cut 88 between the protective padded portion 70 and the protective padded portion 72. Another vent opening 96 is preferably disposed along the second angled cut 90 between protective padded portions 66 and 68. The vent openings 92, 94, 96 are located along die cuts 86, 88 and 90, which do not correspond to joints of a user's hand and, therefore while there is some relative movement of the protective pads in which the vent openings are formed, the movement is not sufficient to cause a portion of a user's hand to be exposed. Further, unlike prior vent openings which were typically formed along horizontal cuts, which result in the back of a user's hand being exposed to contact as the glove flexed, the disclosed vent openings 92, 94, 96 are located along non-horizontal cuts and thus can be made larger as the potential for exposure is minimal. It should be understood that while three vent openings are disclosed on the rear portion 60 of the glove 10, any number of vent openings may be utilized. Additionally, the vent openings may be disposed in a variety of other locations along the rear portion 60 in accordance with the preferred embodiment, including within the respective individual padded portions themselves, instead of along the die cuts.

The finger portions 20 each have a respective padded portion 98 that extends from the second lengthwise cut 84 to the respective tip of each finger portion 100. As with the hand portion 18, each of the padded portions is disposed on an inner fabric layer 64 that overlies each of the finger portions 20. The hand portion 18 of the glove 10 has a first side portion 102 connecting the side 80 of the hand portion 18 to the palm portion 62. The other side 82 of the hand portion 18 has a side portion 104 which extends between the hand portion 18 and a thumb portion 22. The thumb portion 22 is in turn connected to the palm portion 62 on its other side.

The first side 102 of the glove preferably has a mesh layer 106 extending between one side 80 of the hand portion 18 and the palm portion 62 with a protective padded portion 108 secured thereon. The second side 104 of the glove also has a protected padded portion that is sub-divided into a first padded portion 110 and a second padded portion 112 by a vertical die cut 114 formed therein. A side vent opening 116 is preferably formed along the vertical cut 14 between the first padded portion 110 and the second padded portion 112 of the second side 104 of the glove 10. The thumb portion 22 has a plurality of protected padded portions formed thereon. The thumb portion 22 has a first padded portion 120 disposed adjacent a second padded portion 122 and separated by a horizontal cut 124. The second padded portion 122 is disposed adjacent a third padded portion, which is sub-divided into a first part 126 and a second part 128 by a vertical cut 130. A second horizontal cut 132 is disposed between the second padded portion 122 and the first and second parts of the third padded portion 126, 128.

Figure 4:
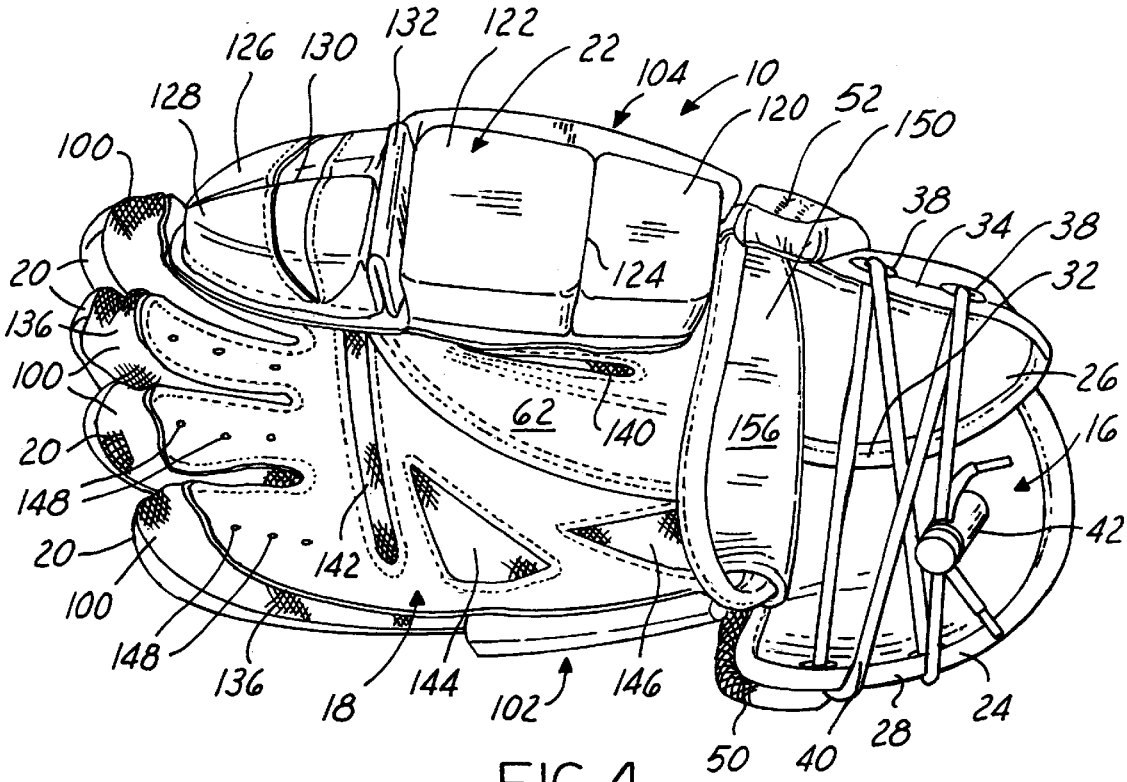
FIG. 4 is a bottom view of a protective sports glove in accordance with a preferred embodiment of the present invention.
Figure 5:
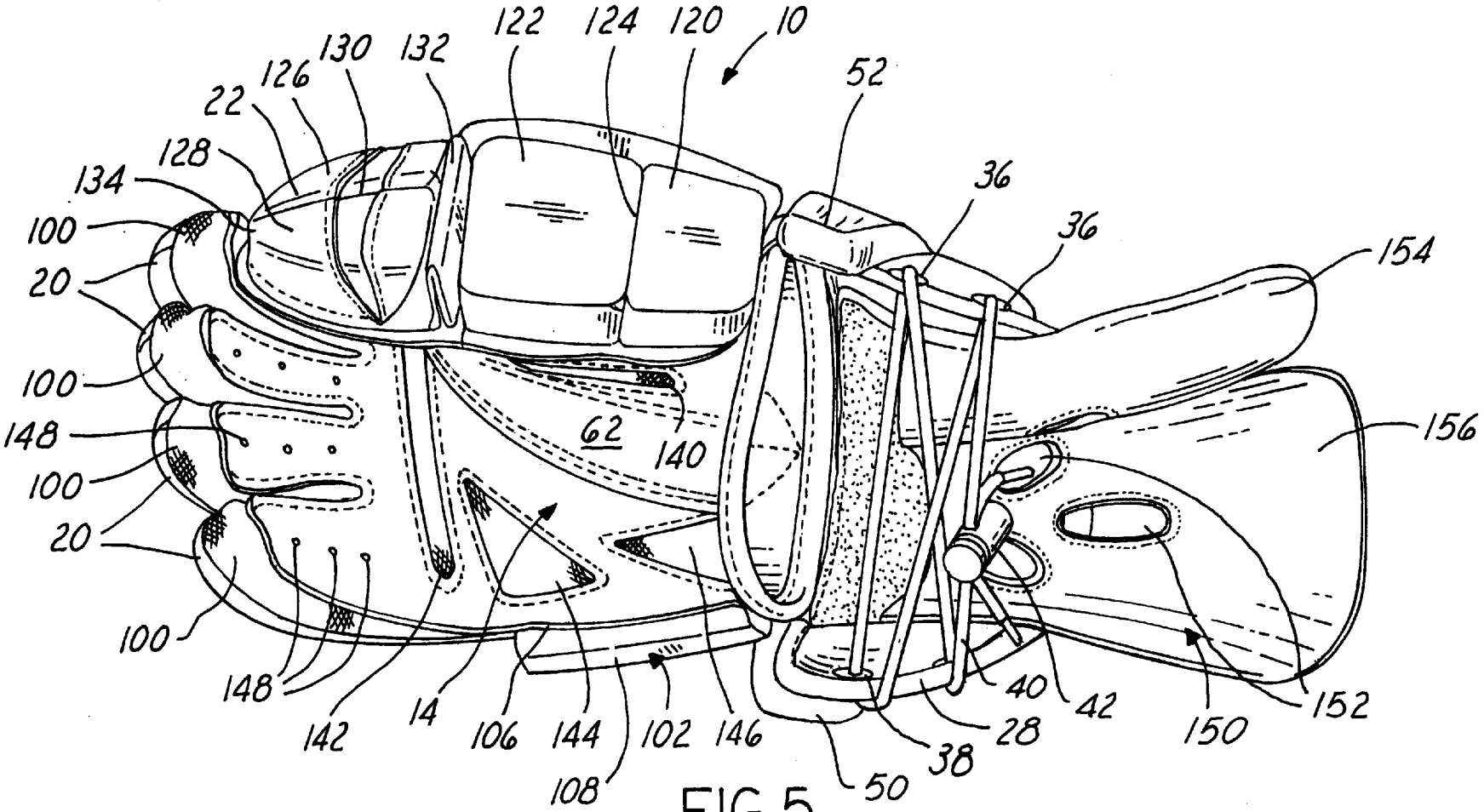
FIG. 5 is a bottom view of a protective sports glove illustrating the inner flap portion in accordance with a preferred embodiment of the present invention.

Referring now to FIGS. 4 and 5, which illustrate the palm portion 62 of the lacrosse glove, in more detail. The palm portion 62 extends from the lower edge of the hand portion 18 adjacent the seam 46 to the tips 100 of the finger portions 20 and the tip 134 of the thumb portion 22. The palm portion 62 is attached to each of the respective padded portions 98 of each finger portion 20 by a mesh layer 136. The mesh layer 136 allows for flexibility of the fingers within the finger portions 20 as well as to provide sufficient ventilation through the mesh layer 136 to a user's fingers. As shown, the palm portion 62 is preferably comprised of a durable material such as leather, a synthetic material, or any other known suitable material, generally illustrated by reference number 138. Mesh portions 140, 142, 144, and 146 are preferably located throughout the palm portion 62 to provide ventilation to a user's palm. The mesh portions are located in the palm portion 62 in areas that are not intended as primary contact areas for a stick. This is contrary to prior gloves that provide much larger mesh portions on the palm portion with mesh, which tend to wear and rip and thus render the glove illegal.

The first mesh portion 140 is preferably located at the junction between the palm portion 62 and the thumb portion 20. The first mesh portion 140 allows the thumb portion 20 to move with respect to the palm portion 62 without causing the palm material to bunch or bulge as typically occurs if the entire palm portion is formed of a wear-resistant material. Additionally, the second mesh portion 142 is disposed on the palm portion 62 at the junction between the hand portion 18 and the finger portions 20 to allow relative movement therebetween and to prevent bunching up of material at that joint as would typically occur if that portion were comprised of a wear-resistant material. Each of the finger portions 20 has a plurality of finger vent holes 148 formed in the durable wear-resistant material to provide ventilation to the user's fingers. The finger vent holes 146 are preferably formed by punching and must be formed far enough apart to prevent the durable material from ripping or tearing. The third mesh portion 144 and the fourth mesh portion 146 are also disposed in areas that are not likely to wear due to contact with a stick. The mesh portions 144, 146 are also disposed in locations that allow the glove to flex and therefore prevent bunching. Further, all of the mesh portions 140, 142, 144, 146, provide ventilation to the user's palm. It should be understood that more or less mesh portions may be included and the locations shown are merely exemplary and may obviously vary.

Figure 7:
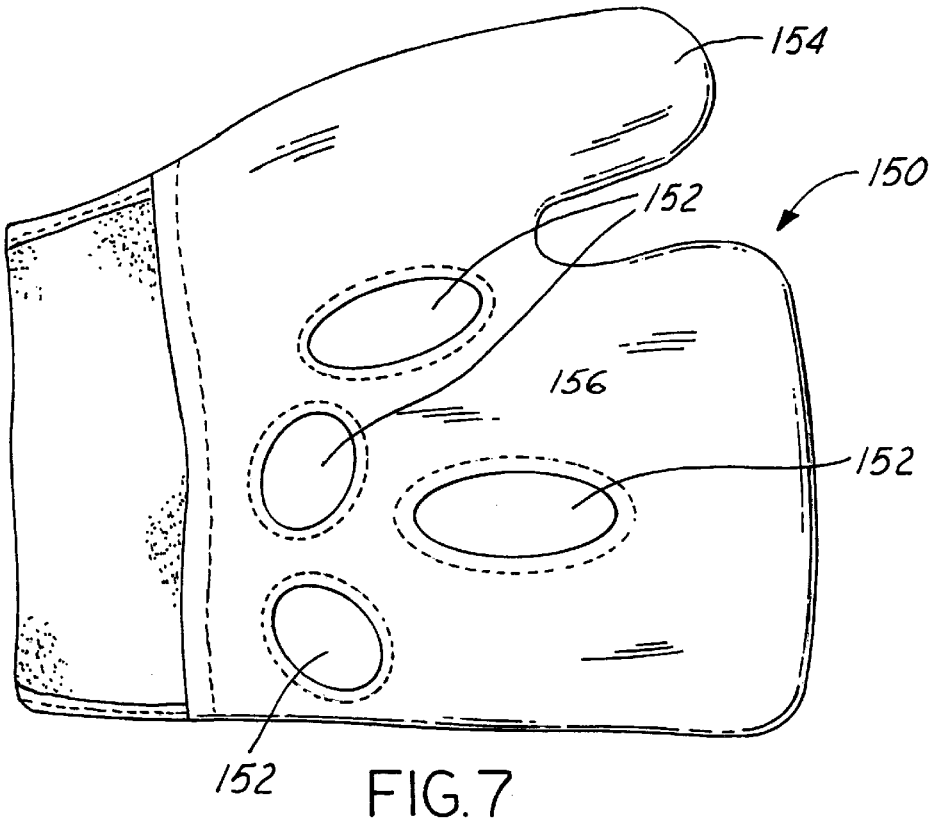
FIG. 7 is an illustration of the inner flap portion for a protective sports glove in accordance with a preferred embodiment of the present invention.

As shown in FIGS. 5 and 7, the glove 10 preferably has a flap portion 150 which is secured to the rear side of the cuff portion 16 and can move into and out of the interior portion of the glove. The flap portion 150 is shown in an inserted position inside the glove in FIG. 4 and is shown in a withdrawn position in FIG. 5. The flap portion 150 when in the inserted position, is designed to provide a better fit for the user's hand by taking up any excess space between the back of the user's hand and the underside of the hand portion 18. The flap portion 150 has a plurality of openings 152 formed therein, which correspond to a respective vent opening formed in the rear portion 60 and the second side 104 of the glove 10. The flap portion is preferably comprised of a foam or padded material so as to further protect the back of a user's hand from contact with a stick. As the flap portion 150 spans the seam 46 in the inserted position, it also assists the wrist guard 48 in preventing the back of a user's forearm or wrist from being exposed to contact with a stick. The flap portion 150 has a thumb portion 154 which preferably extends into the thumb portion 22 of the glove 10 to help to provide a better fit in the thumb portion and a palm portion 156 that helps provide a better fit for the hand.

Having now fully described the invention, it will be apparent to one of ordinary skill in the art that many changes and modifications can be made thereto without departing from the spirit or scope of the invention as set forth herein.

What is claimed is:

1. A protective sports glove, comprising:

a cuff portion for engaging at least a portion of a user's forearm;

a hand portion elastically coupled to said cuff portion, said hand portion having a palm portion and an opposing back portion having a plurality of protective padded portions secured thereon;

a plurality of finger portions secured to and extending from said hand portion for receipt of a user's fingers therein;

a thumb portion secured to and extending from said hand portion;

a wrist guard elastically coupled to said hand portion;

a plurality of vent openings formed in said back portion of said hand portion;

said palm portion being primarily comprised of a durable material and having a plurality of mesh portions disposed on said palm portion in areas that are not intended to primarily contact a stick.

2. The protective sports glove of claim 1, wherein said cuff portion comprises a first portion and a second portion, with a portion of said first portion overlying said second portion.

3. The protective sports glove of claim 1, wherein each of said plurality of finger portions has a rear padded portion, an opposing palm portion, and a substantially mesh side portion extending between said rear padded portion and said opposing palm portion.

4. The protective sports glove of claim 1, wherein one of said plurality of palm mesh portions is located at a junction between said plurality of finger portions and said palm portion.

5. The protective sports glove of claim 1, wherein one of said plurality of palm mesh portions is located at a junction between said thumb portion and said palm portion.

6. The protective sports glove of claim 1, wherein said back portion of said hand portion has a vertical cut portion that extends generally from a base of said hand portion to said finger portions.

7. The protective sports glove of claim 6, wherein one of said plurality of vent openings is formed along said vertical cut portion.

8. The protective sports glove of claim 1, wherein a side portion having a protective padded portion extends between said back portion and said thumb portion.

9. The protective sports glove of claim 8, wherein a vent opening is formed in said protective padded portion on said side portion.

10. A protective sports glove, comprising:

a cuff portion;

a hand portion coupled to said cuff portion, said hand portion having a palm portion and a back side portion having protective padding formed thereon and extending between a first side of said back side portion and a second side of said back side portion;

a plurality of finger portions extending from said hand portion;

at least one generally horizontal seam formed in said padding on said back side portion and extending from said first side of the glove to said second side of the glove;

at least one generally vertical seam formed in said padding on said back side portion; and at least one vent opening formed along said vertical seam.

11. The glove of claim 10, further comprising:

a wrist guard coupled to a back side of the glove to cover any area on a user's hand or wrist that can be exposed by relative movement of said cuff portion and said hand portion.

12. The glove of claim 11, wherein said wrist guard is coupled to said hand portion.

13. The glove of claim 11, wherein said wrist guard is coupled to said cuff portion.

14. The glove of claim 11, wherein said wrist guard is permanently coupled to the glove.

15. The glove of claim 11, wherein said wrist guard is at least partially coupled to the glove by an elastic strap.

16. The glove of claim 10, wherein said cuff portion comprises a first portion and a second portion which are intended to move relative to each other to accommodate for movement of a player's wrist.

17. The glove of claim 16, wherein said cuff portion is coupled to said hand portion by a plurality of elastic straps.

18. The glove of claim 10, wherein each of said plurality of finger portions has a rear padded portion and an opposing palm portion, which is constructed of a wear resistant material.

19. The glove of claim 18, wherein each of said plurality of finger portions includes a substantially mesh side portion extending between said rear padded portion and said opposing palm portion.

20. The glove of claim 10, further comprising:

a thumb portion extending from said hand portion, said thumb portion having an outer padded portion and a palm portion, which is constructed of a wear resistant material.

21. The glove of claim 20, wherein at least one vent opening is formed in said thumb portion.

22. The glove of claim 10, wherein said generally vertical seam extends generally from a base of said hand portion to a base of said plurality of finger portions.

23. The glove of claim 10, further comprising:

a flap portion secured to the glove and moveable between a position inside the glove to take up any excess space and a position outside the glove.

24. A protective sports glove, comprising:

a cuff portion;

a hand portion coupled to said cuff portion, said hand portion having a palm portion and a back side portion having protective padding formed thereon and extending between a first side of said back side portion and a second side of said back side portion;

a plurality of finger portions extending from said hand portion;

at least one generally horizontal seam formed in said padding on said back side portion and extending from said first side of the glove to said second side of the glove; and at least one generally vertical seam formed in said padding on said back side portion;

wherein said palm portion is comprised of a wear resistant material with at least one mesh portion that is located in an area that is not intended to be a high use area.

25. The glove of claim 24, wherein one of said one or more mesh portions is located adjacent a junction between said plurality of finger portions and said palm portion.

26. The glove of claim 24, wherein one of said one or more mesh portions is located adjacent a junction between a thumb portion and said palm portion.

27. A protective sports glove, comprising:

a cuff portion;

a hand portion coupled to said cuff portion, said hand portion having a palm portion and a back side portion having protective padding formed thereon and extending between a first side of said back side portion and a second side of said back side portion;

a plurality of finger portions extending from said hand portion;

at least one generally horizontal seam formed in said padding on said back side portion and extending from said first side of the glove to said second side of the glove;

at least one generally vertical seam formed in said padding on said back side portion; and a pair of diagonal seams formed in said back side portion.

28. The glove of claim 27, wherein each of said pair of diagonal seams has a vent opening formed therealong.

29. A protective sports glove, comprising:

a cuff portion;

a hand portion coupled to said cuff portion and having a palm portion and an opposing back portion with a protective padding secured thereto, said palm portion being comprised of a wear resistant material with at least one mesh portion that is located in an area that is not intended to primarily contact a stick handle;

a plurality of finger portions secured to and extending from said hand portion for receipt of a user's fingers therein; and a plurality of seams formed in said back portion of said hand portion separating said protective padding into multiple portions;

wherein at least two of said plurality of seams are aligned in different directions with respect to one another and one of said plurality of seams extends substantially from a first side of said back side to a second side.

30. The glove of claim 29, wherein at least one of said plurality of seams runs generally across the glove from one side to the other to divide said protective padding into a forward portion and a rear portion which are moveable with respect to one another.

31. The glove of claim 29, wherein at least one of said plurality of seams runs from a base of said hand portion to said plurality of finger portions to divide said protective padding into a pair of side portions which portions are moveable with respect to on another.

32. The glove of claim 29, further comprising:

a wrist guard coupled to a back side of the glove to cover any open area exposed between said cuff portion and said hand portion.

33. The glove of claim 32, wherein said wrist guard is coupled to said hand portion.

34. The glove of claim 32, wherein said wrist guard is coupled to said cuff portion.

35. The glove of claim 32, wherein said wrist guard is permanently coupled to the glove.

36. The glove of claim 32, wherein said wrist guard is at least partially coupled to the glove by an elastic strap.

37. The glove of claim 29, wherein said cuff portion comprises a first portion and a second portion which are intended to move relative to one another to provide flexibility.

38. The glove of claim 29, wherein said cuff portion is coupled to said hand portion by a plurality of elastic straps.

39. The glove of claim 29, wherein each of said plurality of finger portions has a rear padded portion and an opposing palm portion, which is constructed of a wear resistant material.

40. The glove of claim 29, further comprising:

a thumb portion extending from said hand portion, said thumb portion having an outer padded portion and a palm portion, which is constructed of a wear resistant material.

41. The glove of claim 40, wherein at least one vent opening is formed in said thumb portion.

42. The glove of claim 29, wherein said at least one mesh portion is located adjacent a junction between said plurality of finger portions and said palm portion.

43. The glove of claim 39, wherein each of said plurality of finger portions includes a substantially mesh side portion extending between said rear padded portion and said opposing palm portion.

44. The glove of claim 29, wherein said at least one mesh portion is located adjacent a junction between a thumb portion and said palm portion.

45. The glove of claim 29, further comprising one or more vent openings in said back portion.

46. The glove of claim 29, wherein said plurality of seams includes at least one diagonal seam formed in said back side portion.

47. The glove of claim 46, wherein said at least one diagonal seam has a vent opening formed therealong.

48. A protective sports glove, comprising:

a cuff portion;

a hand portion coupled to said cuff portion and having a palm portion and an opposing back portion with a protective padding secured thereto;

a plurality of finger portions secured to and extending from said hand portion for receipt of a user's fingers therein;

a plurality of seams formed in said back portion of said hand portion separating said protective padding into multiple portions;

wherein at least two of said plurality of seams are aligned in different directions with respect to one another and one of said plurality of seams extends substantially from a first side of said back side to a second side and another of said plurality of seams runs from a base of said hand portion to said plurality of finger portions to divide said protective padding into a pair of side portions which portions are moveable with respect to one another; and wherein at least one vent opening is formed in said seam that runs from said base of said hand portion to said plurality of finger portions.

49. A protective sports glove, comprising:

a palm;

a protective back portion extending over said palm, said palm being comprised of a wear resistant material with at least one mesh portion that is located in an area that is not intended to be a high use area;

a cuff flexibly attached to said palm and said back portion;

a plurality of finger portions connected to said palm and said back portion and extending therefrom;

a first seam formed in said back portion and extending from said cuff toward said plurality of finger portions;

a second seam formed in said back portion and extending from a first side of said back portion to a second side of said back portion.

50. The glove of claim 49, wherein said first seam is generally straight.

51. The glove of claim 49, wherein said second seam is generally straight.

52. The glove of claim 49, further comprising:

a wrist guard coupled to said back portion of the glove to cover any area where said cuff is flexibly attached to said back portion.

53. The glove of claim 49, wherein said cuff portion comprises a first portion and a second portion which are intended to move relative to each other to accommodate for movement of a player's wrist.

54. The glove of claim 49, wherein said cuff portion is coupled to said hand portion by a plurality of elastic straps.

55. The glove of claim 49, further comprising:

at least one vent opening located in said back portion.

56. The glove of claim 49, further comprising:

a pair of diagonal seams formed in said back portion.

57. The glove of claim 56, wherein each of said pair of diagonal seams has a vent opening formed therealong.

58. A protective sports glove, comprising:

a palm;

a protective back portion extending over said palm;

a cuff flexibly attached to said palm and said back portion;

a plurality of finger portions connected to said palm and said back portion and extending therefrom;

a first seam formed in said back portion and extending from said cuff toward said plurality of finger portions;

a second seam formed in said back portion and extending from a first side of said back portion to a second side of said back portion; and at least one vent opening located in said back portion, wherein said at least one vent opening is formed at said first seam.

59. A protective sports glove, comprising:

a palm;

a protective back portion extending over said palm;

a cuff flexibly attached to said palm and said back portion;

a plurality of finger portions connected to said palm and said back portion and extending therefrom;

a first seam formed in said back portion and extending from said cuff toward said plurality of finger portions;

a second seam formed in said back portion and extending from a first side of said back portion to a second side of said back portion; and at least one vent opening located in said back portion, wherein said at least one vent opening is formed at said second seam.

60. A protective sports glove, comprising:

a cuff portion;

a hand portion coupled to said cuff portion, said hand portion having a palm portion and a back side portion with protective padding formed thereon, said palm portion being comprised of a wear resistant material with at least one opening formed therein;

a plurality of finger portions extending from said hand portion;

a mesh portion located in said at least one opening in said wear resistant material to provide ventilation to a wearer's hand.

61. The glove of claim 60, wherein said palm portion includes a plurality of openings formed in said wear resistant material with each of said plurality of openings having a mesh portion located therein.

62. The glove of claim 60, wherein said at least one opening is formed in said wear resistant material in a location that is not intended to primarily engage a lacrosse stick.

63. The glove of claim 60, wherein said at least one opening is formed in said wear resistant material adjacent a junction between said plurality of finger portions and said palm portion.

64. The glove of claim 60, wherein said at least one opening is formed in said wear resistant material adjacent a junction between a thumb portion and said palm portion.

65. The glove of claim 60, wherein each of said plurality of finger portions includes a substantially mesh side portion extending between a protective padding on said back side portion and a wear resistant material on said opposing palm portion.

66. The glove of claim 60, further comprising:

at least one generally horizontal seam formed in said protective padding on said back side portion, which extends from a first side of said back side portion and a second side of said back side portion.

67. The glove of claim 66, further comprising:

at least one generally vertical seam formed in said padding on said back side portion.

68. The glove of claim 67, further comprising:

at least one vent opening formed along said at least one generally vertical seam.

69. The glove of claim 66, further comprising:

at least one vent opening formed along said at least one generally horizontal seam.

* * * * *

UNITED STATES PATENT AND TRADEMARK OFFICE

CERTIFICATE OF CORRECTION

PATENT NO. : 6,550,069 B1
DATED : April 22, 2003
INVENTOR(S) : David Morrow

It is certified that error appears in the above-identified patent and that said Letters Patent is hereby corrected as shown below:

Column 9,
Line 45, to read as follows: -- moveable with respect to one another. --

Signed and Sealed this

Twenty-seventh Day of January, 2004

JON W. DUDAS
*Acting Director of the United States Patent and Trademark Office*